United States Patent [19]

Lowry et al.

[11] 4,284,971

[45] Aug. 18, 1981

[54] OVERHEIGHT VEHICLE DETECTION AND WARNING SYSTEM

[76] Inventors: Elliot G. Lowry, 3141 S. 3075 East, Salt Lake City, Utah 84109; Lloyd N. Forster, 443 Garfield, Salt Lake City, Utah 84115

[21] Appl. No.: 25,939

[22] Filed: Apr. 2, 1979

[51] Int. Cl.[3] ..... G08B 25/00; G08G 1/04

[52] U.S. Cl. ..... 340/52 R; 250/222 R; 346/107 VP; 340/31 R; 340/38 P

[58] Field of Search ..... 340/52 R, 61, 31 R, 340/31 C, 38 R, 38 P; 346/107 VP; 250/222 R

[56] References Cited

U.S. PATENT DOCUMENTS

| | | | |
|---|---|---|---|
| 3,206,748 | 9/1965 | Miller | 340/31 C |
| 3,222,682 | 12/1965 | Scott | 340/31 C X |
| 3,275,984 | 9/1966 | Barker | 340/31 R |
| 3,419,847 | 12/1968 | Bonney | 340/61 X |
| 3,716,833 | 2/1973 | Roth | 340/61 |
| 3,896,414 | 7/1975 | Rulo | 340/31 R |
| 4,063,283 | 12/1977 | Rider et al. | 340/61 X |

*Primary Examiner*—Donald J. Yusko
*Assistant Examiner*—Joseph E. Nowicki
*Attorney, Agent, or Firm*—Terry M. Crellin; B. Deon Criddle

[57] ABSTRACT

A system for alerting drivers of vehicles which have an overall height too great to clear an overhead obstruction in their path. Respective pairs of cooperating light sources and light sensors are spaced at appropriate distances from each other and in advance of the overhead structure, with the light beam from each light source being directed to the corresponding light sensor with which such light source is paired. The respective light beams are momentarily interrupted or broken as a vehicle having an excessive overall height passes the successive pairs of light sources and light sensors. When the light beams have been broken in sequence and within a preset, given time period, a signal is sent to the control station which in turn activates a visible, flashing, electric sign indicating that the approaching vehicle is too high to clear the obstruction and warning the driver of the vehicle to stop or exit from the thoroughfare. If the light beams are not broken in sequence within the preset time period, the system will automatically clear and reset itself to ready status. A message of the overheight vehicle can be transmitted to the proper highway authorities simultaneously with the activation of the warning sign. A mechanical sensor can be located on the overhead structure, with an associated camera to take a picture of the vehicle if the driver fails to stop and collision with the overhead structure occurs. A collision message can also be transmitted to proper highway authorities.

9 Claims, 3 Drawing Figures

OVERHEIGHT VEHICLE DETECTION AND WARNING SYSTEM

BACKGROUND OF THE INVENTION

1. Field

The invention relates to systems of detecting vehicles having an overall height too great to clear an impending overhead obstruction on the thoroughfare on which the vehicle is being driven, and of warning the drivers of such vehicles of the impending danger.

2. State of the Art

The potential danger to property and life resulting from collisions between an overhead obstruction such as a bridge, railroad tressel, overhanging roadway signs, etc., and highway vehicles having an overall height in excess of the clearance afforded by the overhead obstruction is well recognized, and several methods have been utilized to warn the drivers of such vehicles of the impending danger. Large signs stating the clearance are customarily posted by all low-clearance obstructions. More positive action systems have been proposed including a photosensitive device located in advance of the obstruction, wherein the device is designed to be capable of determining if passing vehicle is too high and of activating a visible warning to the driver of such vehicle in time for the driver to stop the vehicle before the overhead obstruction is reached. Such photosensitive systems have been found to be unsatisfactory due to the propensity of such systems to give false warnings. Birds and other airborne matter such as leaves, pieces of paper, etc., can readily activate the photosensitive device of such systems by momentarily interrupting the light beam, and thus the system would give a false warning of an impending collision.

Much more sophisticated warning systems have also been proposed. In U.S. Pat. No. 3,419,847, a system is disclosed comprising a transmitting device located at the obstruction. The transmitting device is adapted to transmit a modulated radio carrier frequency wherein the modulated frequency is related to the clearance of the obstruction. Radio receivers which are adapted to receive the modulated frequency are installed on vehicles which may attempt to pass under such obstruction. Means are provided with the radio receiver for decoding the modulated frequency and comparing the indicated height with the height of the vehicle. If the vehicle's height is less than the indicated height of the obstruction, the device produces a signal so indicating to the driver of the vehicle.

3. Objectives

A principal objective of the present invention is to provide a reliable, photosensing system for alerting drivers of vehicles having a height which will not clear an impending overhead obstruction of the impending danger. An additional objective is to provide a warning system which transmits a recorded message to proper highway authorities that a problem exists and that assistance is needed to reroute the overheight vehicle. A further objective is to provide a warning system which is also adapted to take pictures which would identify the vehicle in those instances wherein the driver does not heed or otherwise ignores the visible warning which is given and a resulting collision occurs with the overhead obstruction. A still further objective is to provide a warning system which transmits a recorded message to proper highway authorities when a collision has occurred with the overhead obstruction.

SUMMARY OF THE INVENTION

In accordance with the present invention, a height clearance indicator and warning system is provided for use on a thoroughfare in advance of overhead obstructions, such as overpasses, railroad tressels, overhead signs, and the like, which traverse the roadway and which become low clearance hazards for vehicles having a height in excess of the clearance afforded by the obstruction. The indicator and warning system comprises at least two light sources located on either side of the thoroughfare in advance of the overhead obstruction. The light sources are spaced from each other in series along the thoroughfare so that a vehicle approaching the obstruction will pass the light sources one at a time in sequential order. The light sources are also mounted at a height above the thoroughfare substantially equal to or, for safety purposes, somewhat less than the clearance of the impending overhead obstruction.

A number of light sensors, equal to the number of light sources, are paired with the light sources, with each light sensor being located across the thoroughfare in the vicinity of its respective light source. The light sensors are also mounted at a height above the thoroughfare substantially equal to the clearance of the upcoming overhead obstruction. A beam of light is directed from each of the light sources to the corresponding light sensors. When a vehicle, which has an overall height greater than the clearance afforded by the impending overhead obstruction, passes a respective pair of light sources and sensors, it breaks the light beam associated therewith. Thus, as the vehicle passes the complete series of light sources and sensors, the respective beams of light associated with the respective pairs of light sources and sensors are broken in sequential order. Throughout the specification and claims, the term broken, when used with respect to the light beams, is intended to encompass any momentary interruption of the light beam between the light source to the light sensor.

Means are provided for detecting when the light beams from the respective pairs of light sources and sensors have been broken. When the series of light beams are broken in sequence within a given, preset time period, the detector means activates a signal producing means which then sends the signal to a control means. Upon receiving the signal, the control means activates a visible electric sign warning the driver of the vehicle which is approaching the overhead obstruction to stop because the vehicle is too high to safely clear the obstruction.

The requirement that the multiple light beams be broken in sequence within a given preset time period insures that the warning system will not be unintentionally activated by a bird or other airborne matter which might break one of the light beams but would not likely break all the light beams in sequential order. To insure against activation of the warning system by a series of individual instances in which a bird or other airborne matter breaks one light beam at a time, with the cumulative breaking of the light beams being in sequential order, the detector means and signal producing means are adapted to produce a signal only when the light beams are broken in sequence and within a preset, given time period. Means are provided for clearing the detector and resetting the system to ready status whenever one or more of the light beams have been broken but they occurred out of sequence or the necessary sequence was not achieved within the given time period.

In combination with the control means, transmission means can be provided for transmitting a message to proper highway authorities that a problem with an oversize vehicle exists at the particular location and that assistance may be needed in rerouting the vehicle. Further, a mechanical sensing device can be located on the overhead obstruction for detecting if a collision occurs with the obstruction. The collision sensing device may activate a camera which is located so that a picture is obtained which can be used to identify the vehicle involved in the collision to aid in apprehension and conviction of the negligent driver of the vehicle. In addition to or in place of activating a camera located at the obstruction, the collision sensing device can be adapted to transmit a message to proper highway authorities that a collision has occurred.

Additional objects and features of the invention will become apparent from the following detailed description taken together with the accompanying drawings.

THE DRAWINGS

A particular embodiment of the present invention representing the best mode presently contemplated of carrying out the invention is depicted in the accompanying drawings, in which.

DETAILED DESCRIPTION OF ILLUSTRATED EMBODIMENT

In accordance with the invention, a system is provided for alerting drivers of trucks or other vehicles that the overall height of the truck or vehicle is too great to clear an overhead obstruction which is directly in the path of the truck or vehicle. The system provides a visual warning to the driver of the impending danger. An audible warning can also be provided. In addition, the system can be readily adapted to provide for transmitting a recorded message to proper highway authorities that a problem exists and that assistance might well be needed to reroute the overheight vehicle. The system can also be adapted to provide positive identification of any vehicle which collides with the obstruction.

Figure 1:
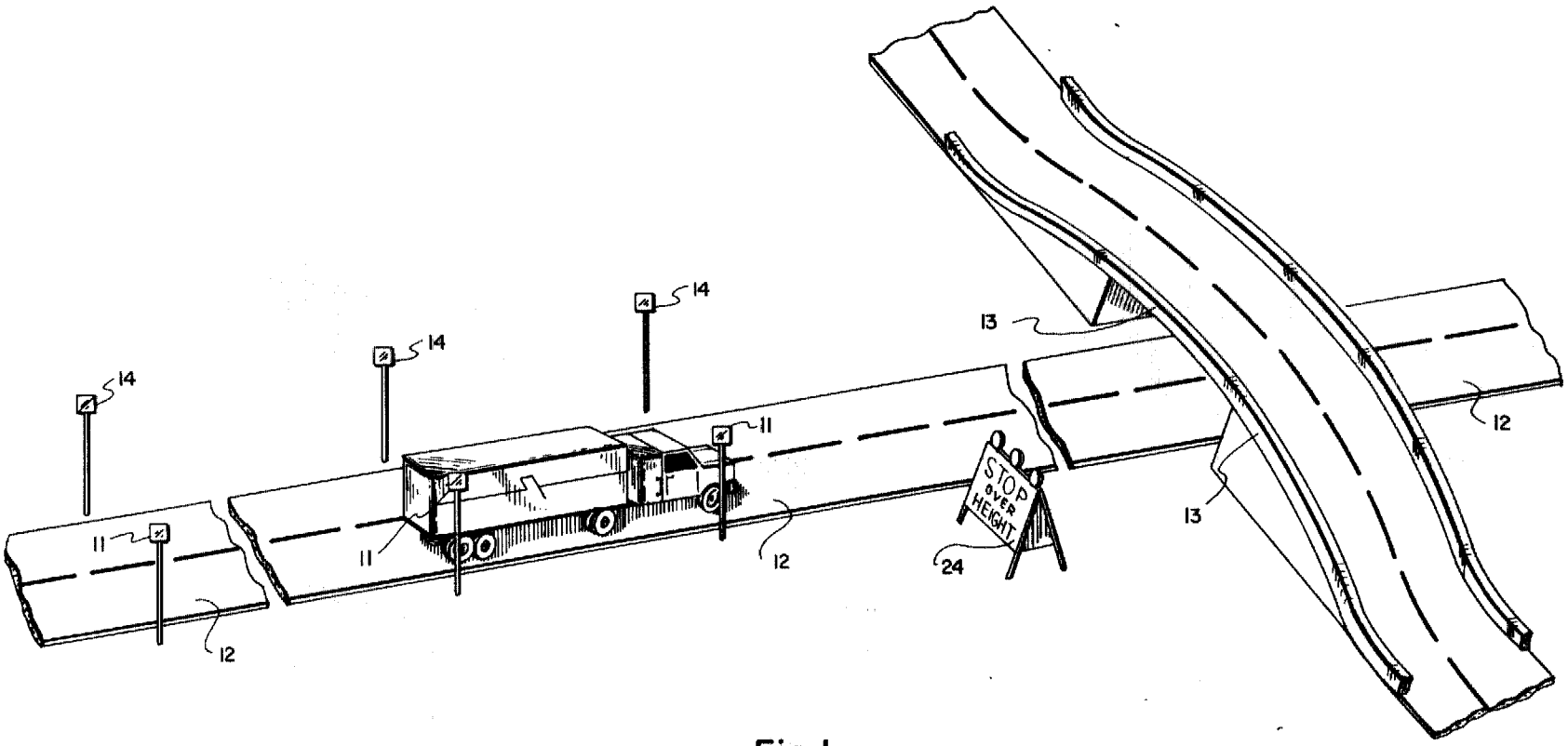
FIG. 1 is a pictorial of a highway bridge which is provided with an over height warning system in accordance with this invention.

The warning system comprises at least two height detecting units located at spaced apart positions in advance of the overhead obstruction. As shown pictorially in FIG. 1, three light sources 11 are located on either side of the thoroughfare 12. The light sources 11 are elevated to a height above the thoroughfare 12 no greater than the clearance of the impending overhead obstruction, i.e., the bridge 13 as shown in FIG. 1. For practical safety considerations, the light sources 11 are placed at a height somewhat less than the actual clearance. The light sources 11 can all be located on the same side of the thoroughfare 12 as shown in FIG. 1, or they could be indiscriminately located on either side of the thoroughfare 12.

A number of light sensors equal to the number of light sources are provided. Thus, in FIG. 1, three light sensors 14 are paired with the respective light sources 11, with each light sensor 14 located across the thoroughfare 12 in the vicinity of its respective light source 11. The light sensors 14 are mounted at a height above the thoroughfare 12 substantially equal to the height above the thoroughfare 12 of the light sources 11. The light sources 11 can be of the type emitting white light, infrared, black light, or laser beams. Incandescent lamps, as well as arc lights, neon or mercury vapor lamps, and others can be used. In a preferred embodiment, infrared, light emitting diodes are used as the light source. The three pairs of light sources 11 and their respective light sensors 14 are spaced along the thoroughfare 12 in advance of the obstruction. The pairs are spaced from each other sufficiently so that a vehicle, such as the truck 15 shown in FIG. 1, approaching the bridge 13 or other obstruction, such as a railroad tressel, overhead signs, etc., will pass each pair of light sources 11 and sensors 14, one pair at a time, in sequential order.

Figure 2:
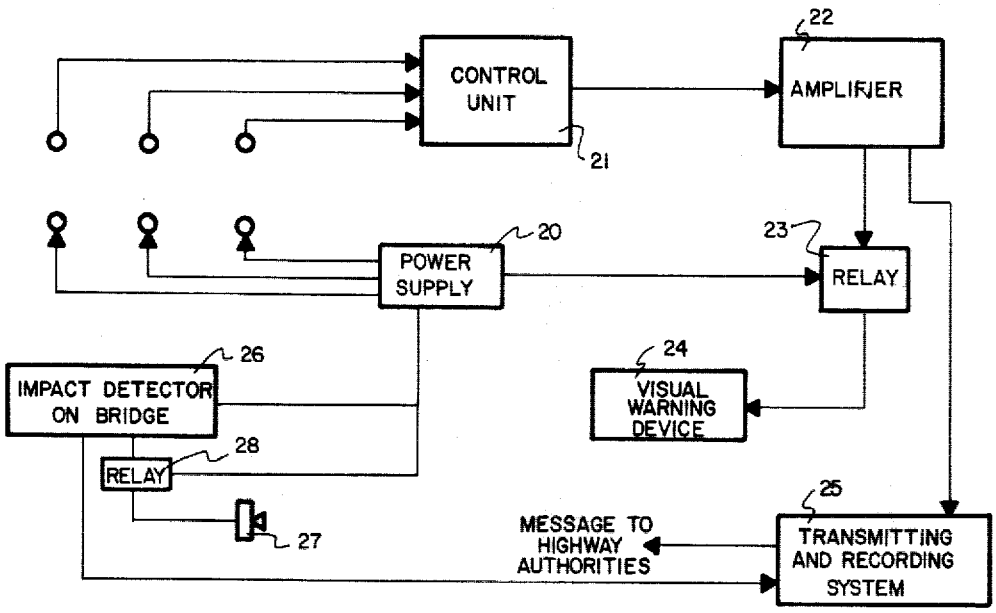
FIG. 2 is a block diagram of a preferred warning system in accordance with this invention.

A block diagram of the warning system is shown in FIG. 2. A power supply 20 provides power for the light sources 11. The light sources 14 produce a signal which is transmitted to a control unit 21. When an overheight vehicle interrupts the light beam directed at the respective light sensors 14, a corresponding interruption in the signal to the control unit is produced. The control unit detects the interruptions from each pair of light sources 11 and sensors 14 and analyzes the sequence and timing of the interruptions. The control unit is adapted to produce a signal, when the analysis of the interruptions indicate that the light beams of the respective pair of light sources 11 and sensors 14 have, within a given, preset time period, been interrupted in sequence starting from the pair of light sources and sensors most remote from the overhead obstruction and ending with the pair nearest said overhead obstruction.

Referring to FIG. 1, as the vehicle 15 passes the most remote pair of light sources 11 and sensors 14, the sensor, hereinafter referred to as sensor 1, sends a signal to the control unit 21 (FIG. 2) that an interruption in the light beam impinging thereon has occurred. Subsequently, the light beams associated with the next two pair of light sources 11 and sensors 14 are interrupted as the vehicle 15 approaches the overhead obstruction, i.e., the bridge 13. The sensor 14 in the middle pair of light sources 11 and sensors 14, hereinafter referred to as sensor 2, and the sensor 14 closest to the obstruction, hereinafter referred to as sensor 3 sequentially monitor the interruption of the light beams associated therewith and send signals to the control unit 21 of such interruption. The control unit 21 assimilates the data from the three sensors and is programmed to activate an alarm if and only if the signals from the sensors were received in sequence and within a minimum time period. Thus, false alarms caused by birds, flying debris such as pieces of paper, etc., or flapping taupaulins on trucks, etc. are essentially eliminated inasmuch as the probability of such causes interrupting the light beams in sequence and within a limited time period is extremely remote.

When the control unit 21 receives signals from sensors 1 through 3 in sequence and within a preset time period, an alarm signal is forwarded to an amplifier 22. The amplified alarm signal then trips a relay 23, which activates the visual warning device 24 as well as an audible alarm if such an alarm is included in the system.

A signal from the amplifier can also be transmitted to a transmitting and recording system 25 which is adapted to record the time and date of the activation of the overheight warning, as well as to transmit a message of the overheight vehicle to proper highway authorities. In a preferred embodiment of the invention, an impact detector 26 (FIG. 2) is provided on the overhead obstruction. In those instances wherein the driver of the overheight vehicle disregards or otherwise ignores the warning system and drives his vehicle into the obstruction, the impact detector is adapted to trip relay 28 which activates a camera and strobe unit 27. The camera and strobe unit 27 is strategically positioned on the overhead obstruction such that either a side, or end picture of the vehicle is taken which can be used by the highway authorities in apprehending and prosecuting the negligent driver. Multiple cameras can be used to obtain multiple views of the vehicle. The impact detector also advantageously sends a signal to the transmitting and recording system 25, which, in turn, transmits a message that a collision with the overhead structure has occurred to the proper highway authorities.

The control unit 21 is further provided with means for resetting the monitoring function, i.e., to continue monitoring for signals from the sensors 14 as well as reset the activation system to a ready status when only a portion of and not all the light beams from the respective light sources 11 are broken within the preset time period or when the light beams are broken but not in proper sequence. Thus, if the light beam associated with sensor 1 is broken by a bird or some object other than an overheight vehicle, the control unit 21 acknowledges the signal of such from sensor 1, but following the preset time period, the control unit clears itself of such signal unless a corresponding signal has been received from sensor 2. Likewise, if the light beams associated with sensor 1 and sensor 2 happen to be broken in sequence within the preset time period by a chance happening, the control unit will clear itself of both signals unless a corresponding signal has been received from sensor 3. If sensor 1 and 3 are activated in sequence, the control unit ignores the signal from sensor 3, and unless a signal from sensor 2 is received within the preset time period, the control unit resets itself to ready status. If sensors 2 or 3 are activated without the prior activation of sensor 1, the control unit 21 ignores the signals received therefrom and remains in its ready status.

Figure 3:
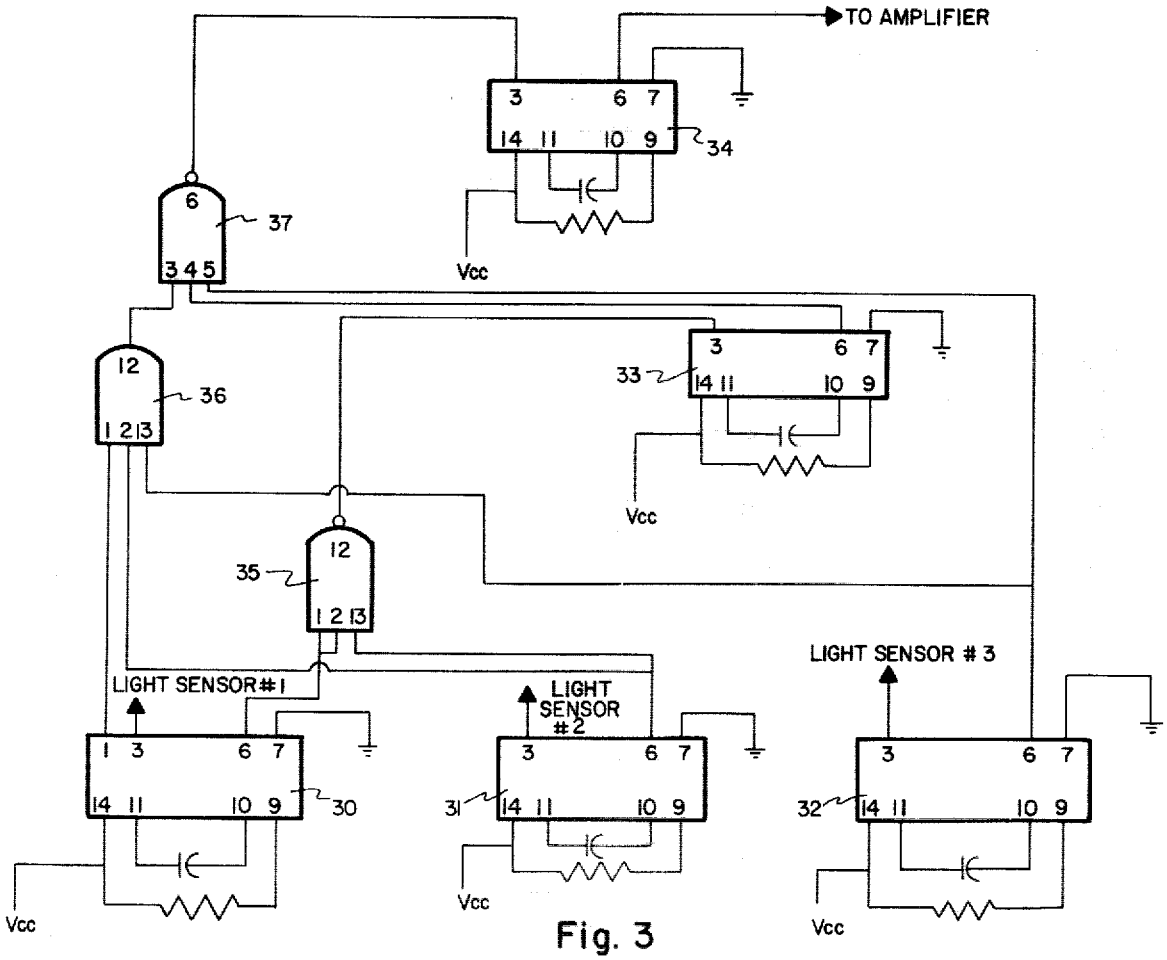
FIG. 3 is an electrical schematic of one embodiment of the control unit of the system shown in FIG. 2.

An electrical schematic drawing of the circuitry of one embodiment of the control unit 21 of this invention is shown in FIG. 3. The circuitry comprises five monostable multivibrators, 30–34, respectively, wherein each multivibrator is a TTL integrated circuit type 74121. In each of the multivibrators 30–34, a supply voltage of 5 volts is applied to pin 7 and pin 14 is grounded. Each multivibrator 30–34 also has a 10 k ohm resistor connected between pins 9 and 14 and a 1,000 micro farad capacitor connected between pins 10 and 11.

The output pin 6 of multivibrator 30 is connected to pin 1 and 2 of one of the positive-nand gates 35 of a TTL integrated circuit type 7410. Pin 13 of gate 35 is connected to output pin 6 of multivibrator 31. Input pins 3 of each of the multivibrators 30–33 are connected, respectively, to the sensors 14 in the pairs of light sources 11 and sensors 14. Pin 3 of the first multivibrator 30 is connected to the sensor 14 most remote from the overhead obstruction, with pins 6 of the respective multivibrators 31 and 32 being connected, in order, to the subsequent sensor 14 and the sensor 14 closest to the overhead obstruction, respectively. During normal operation, i.e., when no overheight vehicle has passed the warning device, the sensors 14 transmit a positive potential signal to pins 3 of the respective multivibrators 30–33. When an overheight vehicle approaches the overhead obstruction, it first interrupts the light beam of the first pair of light sources 11 and sensors 14, and the positive potential signal transmitted from the sensor 14 to pin 3 of multivibrator 30 is momentarily reduced to a lower potential. The multivibrator 30 responds to the momentary low voltage pulse by producing a positive voltage signal having a duration of 10 seconds at pin 6 thereof. The positive voltage pulse produced at pin 6 of multivibrator 30 is transmitted to pins 1 and 2 of the nand gate 35.

Pin 13 of the gate 35 is connected to pin 6 of the second multivibrator 31. As the overheight vehicle continues its approach to the overhead obstruction, it next interrupts the light beam of the second pair of light sources 11 and sensors 14, and the positive potential signal transmitted from the sensor 14 to pin 3 of multivibrator 31 is momentarily reduced to a lower potential. Multivibrator 31 responds to the momentary low voltage pulse by producing a positive voltage signal having a duration of 10 seconds at pin 6 thereof. The positive voltage pulse produced at pin 6 of multivibrator 31 is transmitted to pin 13 of the nand gate 35. If the pulse from pin 6 of the multivibrator 31 is received by pin 13 of gate 35 within the 10 seconds' period in which the corresponding pulse from pin 6 of the first multivibrator 30 is received by pins 1 and 2 of the gate 35, the nand gate 35 responds by reducing the otherwise normally positive voltage at pin 12 thereof to a momentary lower voltage. The momentary lower voltage is transmitted to pin 3 of multivibrator 33, and in response to the momentary low voltage pulse, the multivibrator 33 produces a positive voltage signal having a duration of 10 seconds at pin 6, thereof. This positive voltage pulse is transmitted to pin 4 of nand gate 37.

Now, as the overheight vehicle continues its approach to the overhead obstruction, it next interrupts the light beam of the third pair of light sources 11 and sensors 14, and the positive potential signal transmitted from the sensor 14 to pin 3 of multivibrator 32 is momentarily reduced to a lower potential. Multivibrator 32 responds to the momentary low voltage pulse by producing a positive voltage signal having a duration of 10 seconds at pin 6 thereof. The positive voltage pulse produced at pin 6 of multivibrator 32 is transmitted to pin 13 of gate 36 and simultaneously to pin 5 of nand gate 37. Pin 1 of gate 36 is connected to pin 1 of multivibrator 30, and pin 2 of gate 36 is connected to pin 6 of multivibrator 31. For the gate 36 to switch on, i.e., to produce a positive potential at its pin 12, the inputs to pins 1, 2 and 13 thereof must all be simultaneously of a positive potential. Pin 1 of gate 36 will remain constantly at a positive potential, inasmuch as pin 1 of multivibrator 30 remains at a constant positive potential. Pins 2 and 13 of the and gate 36 are of a positive potential during the corresponding 10 seconds' period in which they receive respective pulses of positive potential from pins 6 of multivibrators 31 and 32. Thus, for the and gate 36 to turn on, a positive potential must be produced at pin 6 of multivibrator 31 and then, within 10 seconds following the production of the positive potential at pin 6 of multivibrator 31, a positive potential must be produced at pin 6 of multivibrator 32.

When the and gate 36 turns on, a positive potential pulse is produced at pin 12. The pulse produced at pin 12 of gate 36 has a limited duration as determined by the lapse in time between when the voltage pulses are produced at pins 6 of multivibrators 31 and 32, respectively. In effect, if it takes the vehicle which is approaching the overhead obstruction 3 seconds to travel between the sensor controlling multivibrators 31 and 32, then the pulse produced at pin 12 of gate 36 will have a duration of seven seconds and will be initiated at the same time the vehicle passes the sensor which controls multivibrator 32. The pulse produced at pin 12 of gate 36 is transmitted to pin 3 of nand gate 37. If pins 4 and 5 of gate 37 receive a pulse of positive potential simultaneously with the pulse transmitted to pin 3 thereof, the nand gate 37 responds by reducing the otherwise normally positive voltage at pin 6 thereof to a momentary pulse of lower voltage. The pulse of lower voltage is then transmitted from pin 6 to pin 3 of multivibrator 34, and multivibrator 34 responds by producing a pulse of positive potential at pin 6 thereof, with such pulse having a duration of ten seconds.

The pulse from pin 6 of multivibrator 34 is transmitted to amplifier 22, and the amplified signal is used in operating the relay 23 and, thus, activating the visual warning device 24 and any audible warning device which may also be used in combination with the visual warning device.

For a warning system utilizing the circuitry shown in FIG. 3, the visual warning device is activated for ten seconds and then turned off due to the termination of the positive potential at pin 6 of multivibrator 34. The time period in which the positive potential is maintained at pin 6 of multivibrator 34 is easily adjusted to be made longer by increasing the resistance between pins 9 and 14 thereof. Likewise, the time periods of the pulses generated at pins 6 of the other multivibrators 30–33 can also be made longer by increasing the resistance between the pins 9 and 14 thereof, respectively. If desired, the time periods can be made shorter by decreasing the visual resistance values between pins 10 and 14 and/or decreasing the capacitance values between pins 10 and 11.

The visual device could be made to stay on for about 35 seconds by increasing the resistance between pins 9 and 14 of multivibrator 34 to about 50,000 ohms while holding the capacitance between pins 10 and 11 at 1000 micro farads. A pulse time of about 10 seconds has been found to be advantageous with respect to multivibrators 30–33; however, even these pulse times will vary in actual practice in accordance with the distance between the pairs of light sources 11 and sensors 14. Using the circuitry shown in FIG. 3, the warning device (FIG. 2) and any audible warning device which may be used in addition to the visual device, is activated only when the light beams associated with the three pair of light sources 11 and sensors 14 are interrupted in sequence, and, then, only if the second light beam is interrupted within 10 seconds of the interruption of the first beam and, further, only if the third light beam is interrupted within 10 seconds of the interruption of the second light beam. As mentioned above, the specific time periods between the successive interruptions of the light beams can be readily modified to be made shorter or longer. By requiring that the light beams be interrupted in sequence and within prescribed time limits substantially obviates false alarms wherein the system is falsely activated by birds, wind carried matter such as scraps of paper, or snow flakes, etc.

The system of the present invention continues to provide warning to overheight vehicles even when one or more of the light sources 11 fails. In case of failure of one of the light sources 11, the corresponding light sensor 14 continuously activates the respective multivibrator, and sequential interruption of the light beams associated with the remaining two light sources within the given time limits will activate the alarm. If two of the light sources 11 fail, then interruption of the light beam associated with the third light source would then activate the alarm. If all three light sources 11 failed, the alarm would be continuously activated, and, of course, direct the proper highway authorities to undertake immediate corrective maintenance. A standby electrical system, such as a battery system, can be provided in case of power failure to the warning system. The standby electrical system would be used to activate an auxiliary visual message to the effect that the overheight warning system is temporarily inoperable.

Although the present invention has been illustrated and described with reference to preferred embodiment, it is to be understood that the disclosure is made by way of example and that various other embodiments are possible without departing from the subject matter coming within the scope of the following claims, which subject matter is regarded as the invention.

The highway, bridge, sign, etc., of FIG. 1 are presented for purposes of illustration only, and FIG. 1 is not intended as limiting the scope of the present invention with respect to the type highway the present apparatus is used on, the type overhead obstruction, such as a bridge, or the type visual warning or signs which are used. It should be noted, that the warning system of the present invention could be used on a two-way, secondary highway, or upon divided highways and expressways such as the interstate system of freeways. Thus, the two lane thoroughfare as illustrated in FIG. 1 could represent a dual lane, divided interstate highway in which all the traffic on the two lanes shown is in the same direction, or the thoroughfare could be a highway having two way traffic thereon. In the latter instance, vehicles which approach the warning system from the other side of the bridge would derive no useful warning from the system shown in FIG. 1 inasmuch as they would pass under the bridge prior to passing by the warning system. To warn vehicles coming from the other direction, another warning system would be required on the other side of the bridge. It should also be noted that vehicles coming from under the bridge as shown in FIG. 1 towards the warning system would not have any detrimental effect on the warning system even if they had just barely cleared the bridge and were high enough to then interrupt the light beams in the pairs of light sources 11 and sensors 14. Such a vehicle would not activate the warning system inasmuch as the light beams would be interrupted in opposite sequence to that necessary for activating the system. Further, such a vehicle would not interfere with the proper operation of the warning system in detecting overheight vehicles approaching the bridge from the side on which the warning system is installed.

We claim:

1. A height clearance indicator and warning system for use on a thoroughfare in advance of overhead obstructions, such as overpasses, railroad tressels, overhead signs, and the like, which traverse the roadway and which become low clearance hazards for vehicles having a height greater than the clearance afforded by the obstruction, said indicator and warning system comprising:

at least two light sources located on either side of the thoroughfare in advance of the overhead obstruction, said light sources being spaced from each other along the thoroughfare so that a vehicle approaching said obstruction will pass the light sources one at a time in sequential order, each of said light sources also being mounted at a height above the thoroughfare no greater than the clearance of the impending overhead obstruction;

a number of light sensors equal to the number of light sources, each light sensor being paired with a respective light source and located across the thoroughfare in the vicinity of its respective light source, said light sensors being mounted at a height above the thoroughfare substantially equal to the height above the thoroughfare of said light sources;

detector means for detecting when the light beams from respective light sources to corresponding sensors paired therewith have been momentarily broken;

means for producing a signal when the detector means detects that the light beams from the respective light sources are, within a given, preset time period, broken in sequence starting from the light beam associated with the pair of light sources and sensors most remote from the overhead obstruction and ending with the light beam associated with the pair of light sources and sensors nearest said overhead obstruction;

control means adapted to receive said signal and activate a visible electric sign indicating that the vehicle approaching said overhead obstruction is too high to clear the obstruction and warning the driver of the approaching vehicle to stop; and said means for producing a signal further operating to clear the detector means and thus reset the system to ready status when only a portion of and not all the light beams from the respective light sources are broken within the preset time period, and when the light beams are broken but not in proper sequence.

2. An indicator and warning system in accordance with claim 1, wherein means are combined with the control means for transmitting a message to proper highway authorities that a problem exists.

3. An indication and warning system in accordance with claim 1, wherein means is provided for recording the activation of the electric sign and the time and date that such activation occurred.

4. An indicator and warning system in accordance with claim 1, wherein a mechanical sensing device is located on the overhead obstruction and one or more cameras are positioned with a view of the overhead obstruction, said mechanical sensing device being adapted to activate the cameras if and when the approaching overheight vehicle collides with the overhead obstruction.

5. An indicator and warning system in accordance with claim 4, wherein means are combined with the mechanical sensing device for transmitting a message to proper highway officials that a collision has occurred.

6. An indication and warning system in accordance with claim 4, wherein means is provided for recording that a collision has occurred and the time and date that such collision occurred.

7. An indicator and warning system in accordance with claim 1 which further includes:

A mechanical sensing device located on the overhead obstruction for sensing when a collision with the obstruction has occurred; and transmitting means in combination with the control means and mechanical sensing device for transmitting messages to proper highway authorities that the warning system has been activated and, when a collision occurs, that such a collision with the overhead obstruction has occurred.

8. An indicator and warning system in accordance with claim 7, further including at least one camera positioned with a view of the overhead obstruction, with said mechanical sensing device being adapted to activate the camera if and when a collision occurs with the overhead obstruction.

9. An indicator and warning system in accordance with claim 1, which further includes:

a mechanical sensing device located on the overhead obstruction for sensing when a collision with the obstruction has occurred; and means in combination with the mechanical sensing device for transmitting a message to proper highway officials that a collision with the overhead obstruction has occurred.

* * * * *